US006478663B1

(12) United States Patent
Ganser

(10) Patent No.: US 6,478,663 B1
(45) Date of Patent: Nov. 12, 2002

(54) SANDING DEVICE FOR CURVED SURFACES

(76) Inventor: Bernhard Ganser, Parkweg 11, D-88471 Laupheim (DE)

( * ) Notice: Subject to any disclaimer, the term of this patent is extended or adjusted under 35 U.S.C. 154(b) by 0 days.

(21) Appl. No.: 09/744,571

(22) PCT Filed: Jan. 16, 1999

(86) PCT No.: PCT/DE99/00082

§ 371 (c)(1),
(2), (4) Date: Jan. 26, 2001

(87) PCT Pub. No.: WO00/06339

PCT Pub. Date: Feb. 10, 2000

(30) Foreign Application Priority Data

Jul. 28, 1998 (DE) ..... 198 33 814

(51) Int. Cl.[7] ..... B24B 7/00
(52) U.S. Cl. ..... 451/271; 451/357
(58) Field of Search ..... 451/271, 278, 451/356, 357, 351, 49, 50, 170, 171, 166, 135, 211, 437, 440

(56) References Cited

U.S. PATENT DOCUMENTS 1,700,114 A 1/1929 Thompson
5,749,770 A 5/1998 Uzumcu et al.
6,039,639 A * 3/2000 Pfaundler ..... 451/356
6,129,611 A * 10/2000 Yamaguchi ..... 451/50

FOREIGN PATENT DOCUMENTS

DE 42 33 728 4/1994
DE 195 24 084 1/1997

* cited by examiner

*Primary Examiner*—George Nguyen
*Assistant Examiner*—Dung Van Nguyen
(74) *Attorney, Agent, or Firm*—Collard & Roe, P.C.

(57) ABSTRACT

In a grinding apparatus with a rotor device driving an eccentrically mounted carrier device in which a shaft is mounted provided at one end with a head to which a supporting face for abrasive paper is fastened, facilitated grinding of curved surfaces by hand is obtained by the features that the supporting face is of curved design and has upper and lower sides with the same radius of curvature and is fastened to the head via an elastic element, and at least two guide devices are provided which cause the supporting face to be guided by the head reciprocatingly along a curved surface with the same radius of curvature as the supporting face.

21 Claims, 5 Drawing Sheets

SANDING DEVICE FOR CURVED SURFACES

CROSS REFERENCE TO RELATED APPLICATIONS

Applicants claim priority under 35 U.S.C. §119 of German Application No. 198 33 814.7 filed Jul. 28, 1998. Applicants also claim priority under 35 U.S.C. §120 of PCT/DE99/00082 filed Jan. 16, 1999. The international application under PCT article 21(2) was not published in English.

BACKGROUND OF THE INVENTION

1. Field of the Invention

This invention relates to a grinding apparatus with a rotor device driving an eccentrically mounted carrier device in which a shaft is mounted provided at one end with a head to which a supporting face for abrasive paper is fastened.

2. The Prior Art

Grinding apparatuses of the abovementioned kind are used in the prior art in particular for grinding plane surfaces. For this purpose one fastens to the supporting face an abrasive paper which moves over the surface to be ground due to the eccentric motion of the shaft mounted in the carrier device in the form of superimposed harmonic oscillations, thereby subjecting said surface to a grinding process upon suitable bearing pressure of the abrasive paper. Difficulties always result with conventional grinding apparatuses when curved surfaces are to be ground since the handling of a grinding apparatus is hindered by the fact that only pointwise contact of the plane abrasive paper on the curved surface is always given.

SUMMARY OF THE INVENTION

The problem of the invention is to provide a grinding apparatus for grinding different curved surfaces with simple handling.

For a grinding apparatus of the abovementioned kind this problem is solved in that the supporting face is of curved design and has curved upper and lower sides, the supporting face is fastened to the head via an elastic element, and at least two guide devices are provided which cause the supporting face to be guided by the head reciprocatingly along a curved surface with the same radius of curvature as the supporting face.

Preferred embodiments of the invention are the object of the subclaims.

In the inventive grinding apparatus the feature that the supporting face is of curved design and has curved upper and lower sides, the supporting face is fastened to the head via an elastic element, and at least two guide devices are provided which cause the supporting face to be guided by the head reciprocatingly along a curved surface with the same radius of curvature as the supporting face, results in a grinding apparatus wherein the oscillating motion of the surface of its supporting face is forced along an imaginary curved surface having the same radius of curvature as the upper side of the supporting face due to the fact that the lower side of the supporting face has the same radius of curvature as the surface of the supporting face and the lower side of the supporting face is guided by at least two guide devices which are stationary with respect to the supporting face so as to prevent oscillating motion lateral to the axis of the shaft mounted in the carrier device and the lower side of the supporting face is guided upon lateral motion of the shaft with time-variant pressure against the particular guide devices, in conjunction with an elastic element provided on the head of the shaft and interconnecting the supporting face and the shaft.

The abrasive paper to be used with the inventive abrasive paper support apparatus is preferably applicable to the supporting face in replaceable fashion, for which purpose it is either formed as adhesive abrasive paper or provided with integrated eyes cooperating with hooks provided on the supporting face or another place on the inventive apparatus. To be fastened to a spherically formed supporting face it is provided that the abrasive paper is formed not as a solid surface but like a rosette in order to ensure that no folds form in the paper.

According to a preferred embodiment of the inventive grinding apparatus, the guide devices are provided on the lower side of the supporting face. This obtains in simple and effective fashion the desired guiding effect of the supporting face by the guide devices. It is essential here that the guide devices act on a surface whose radius of curvature corresponds to that of the surface of the supporting face. One can thus fundamentally also conceive of embodiments of the inventive grinding apparatus in which the guide devices adjoin guide faces with an accordingly provided radius of curvature which are spatially separate from the lower side of the supporting face but nevertheless mechanically connected with the supporting face.

The guide devices of the inventive grinding apparatus are preferably formed as ball-bearings, rolling bearings or slide bearings. This ensures that the desired guiding effect of the guide devices on the lower side of the supporting face can be realized with low friction and low material wear. Alternatively, the guide devices can be formed as curved guide faces made of hard material with sliding ability, in particular plastic material, and having a curvature adapted to the lower side of the supporting face. This obtains the desired guiding effect of the guide devices on the lower side of the supporting face in an especially cost-effective way.

According to further preferred embodiments of the inventive grinding apparatus, one can provide three, four or more guide devices. If at least three guide devices are provided, an especially robust and exact guidance of the supporting face is obtained.

The elastic element connecting the supporting face with the shaft mounted in the carrier device is preferably formed as a spring, in particular coil spring. This achieves the result that the lift of the supporting face with respect to the head of the shaft caused by the effect of the guide devices is compensated with a predeterminable, constant force, independently of the particular excursion of the supporting face. Alternatively, the elastic element can be formed as a disk or ring made of elastic material, in particular rubber. It is only essential here that the lifting motion caused by the guide devices between the head of the shaft and the supporting face due to the curvature of the lower side of the supporting face is compensated with as little delay and as uniformly as possible.

The supporting face of the inventive grinding apparatus can have different radii of curvature for different objects to be ground depending on the embodiment. The supporting face can for example be formed cylindrically with a concave upper side for grinding convex surfaces, or formed cylindrically with a convex upper side for grinding concave surfaces. For grinding convex spherical objects the supporting face can be formed spherically with a concave upper side, and for grinding concave spherical surfaces the supporting face can be formed spherically with a convex upper side.

If the supporting face is formed cylindrically, the guide devices are preferably disposed axis-parallel to each other. If the supporting face is formed spherically, four guide devices are preferably provided, being disposed in pairs at right angles to each other. The supporting face can also be formed so as to have at least two different curvatures in two or more planes.

The supporting face of the inventive grinding apparatus is preferably made of hard material, in particular metal or hard plastic material. For special cases of application requiring especially cautious grinding, the supporting face formed of hard material can be mounted softly cushioned on a foamed plastic layer, or a foamed plastic layer can be provided on the supporting face, or the supporting face itself can be made of soft material like wood or foamed plastic.

The inventive apparatus can have an additional eccentric device for controlling the motion of the supporting face further in presettable fashion. The additional eccentric device can be controllable with the aid of centrifugal forces and/or frictional forces. The additional eccentric device permits the inventive apparatus to be advantageously executed such that the supporting face executes a variable motion resulting in a very fine grinding structure.

According to further preferred embodiments of the inventive apparatus, it may be provided that the eccentrically mounted carrier device, the shaft mounted therein or the head provided at one end thereof is mounted in a long hole which turns rotating motion of the particular component into one-dimensional linear oscillating motion. This achieves the result that the oscillating behavior of the supporting face of the inventive apparatus is restricted in predetermined fashion, which leads to simpler handling and is advantageous for certain grinding applications, in particular when the surface to be ground is limited on one side by obstructing objects. The long hole can be disposed vertically so as to produce horizontally extending oscillating motion, or it can be disposed horizontally so as to produce vertically extending oscillating motion.

The inventive grinding apparatus will be explained in the following with reference to preferred embodiments shown in the figures of the drawing.

BRIEF DESCRIPTION OF THE PREFERRED EMBODIMENT

Figure 1:
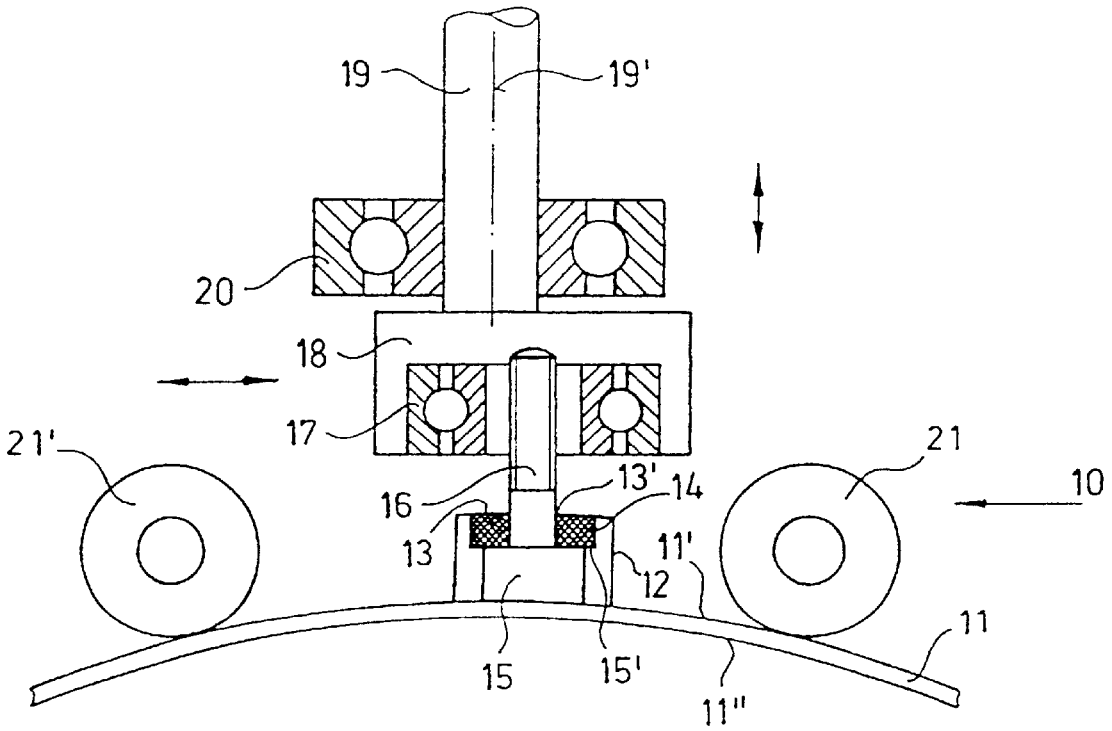
FIG. 1 shows a preferred embodiment of the inventive grinding apparatus in a cross-sectional view.

Grinding apparatus 10 shown in FIG. 1 is provided with supporting face 11 with lower side 11' and upper side 11"in its central area with projection 12 resembling a cylindrical pot with base surface 13 with gap 13' through which shaft 16 with head 15 is guided, head 15 having a diameter dimensioned greater than the diameter of shaft 16 and gap 13' and adjoining with its back 15' rubber ring 14 supported against base surface 13 of projection 12. Shaft 16 is pivotally mounted in bearing device 17 pivotally mounted off-center in body device 18. Body device 18 is driven via shaft 19 mounted in bearing 20 and driven by a rotor device not shown.

Guide devices formed as rolling bearings 21, 21' are provided adjacent lower side 11' of supporting face 11 to define the form of motion of supporting face 11 when the rotor device is turned on and shaft 19 rotates. If rolling bearings 21, 21' were absent, rotation of shaft 19 would cause lateral motion of shaft 16 and thus via head 15 also of supporting face 11 reciprocatingly at right angles to longitudinal axis 19' of shaft 19. Rolling bearings 21, 21' convert said lateral motion into motion along a curved surface with the same radius of curvature as supporting face 11 due to the design of lower side 11' of supporting face 11. This results in a lift of head 15 with respect to base surface 13 of projection 12 which is absorbed elastically by rubber disk 14.

Figure 2:
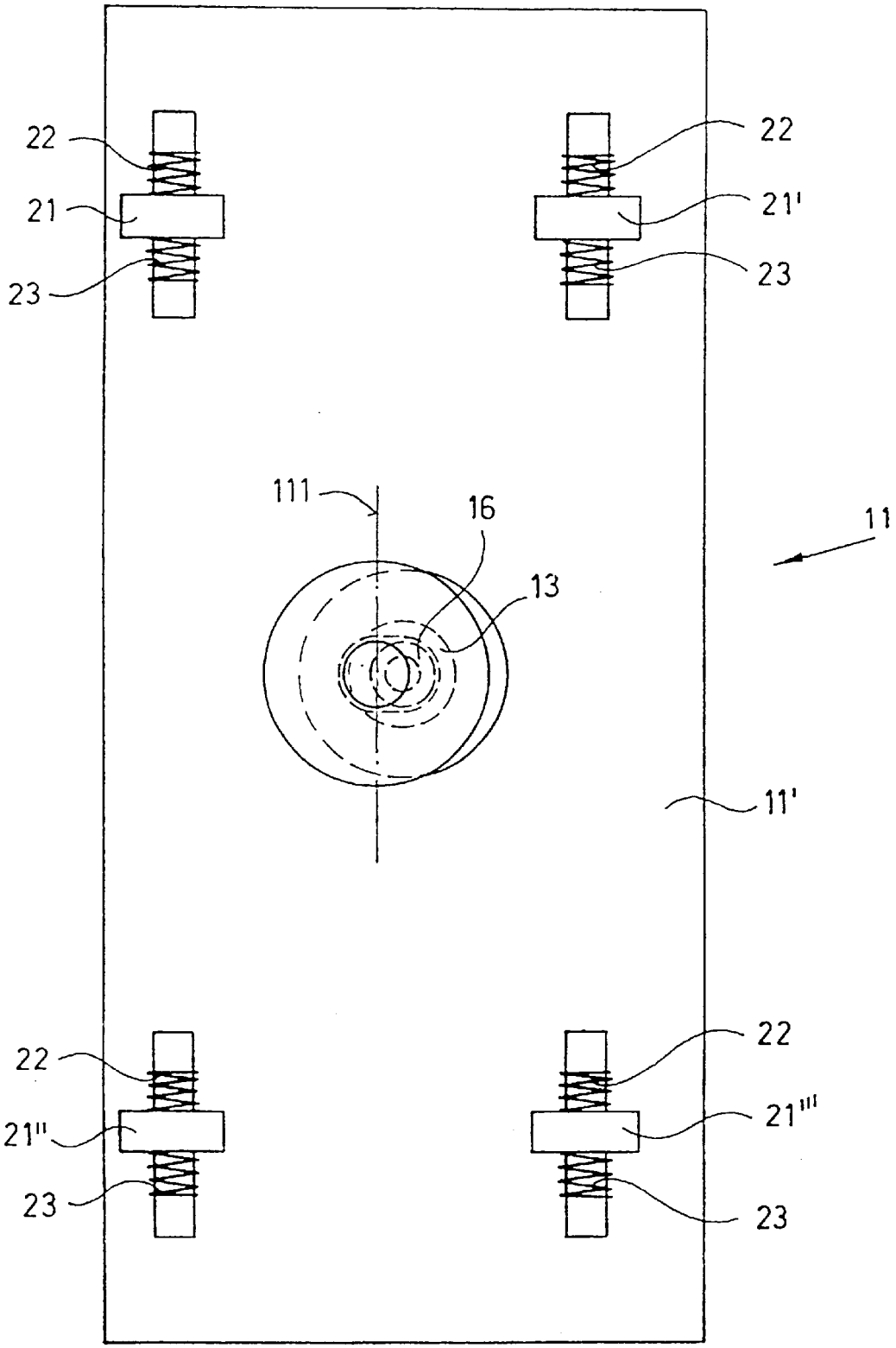
FIG. 2 shows a cylindrically shaped supporting face of the grinding apparatus shown in FIG. 1 in a view from the back.

With supporting face 11 shown in FIG. 2, rolling bearings 21, 21', 21" and 21'" adjacent convexly formed lower side 11' of supporting face 11 are mounted with the aid of springs 22 and 23 so as to absorb oscillations whose direction extends perpendicular to the double arrows shown in FIG. 1 but nevertheless perpendicular to axis 19' of shaft 19 during operation of the inventive grinding apparatus. Supporting face 11 therefore has two degrees of freedom during operation of the inventive grinding apparatus, one allowing reciprocating motion along longitudinal axis 111 of supporting face 11 and the other allowing reciprocating motion along a curved surface with the same radius of curvature as supporting face 11.

Figure 3:
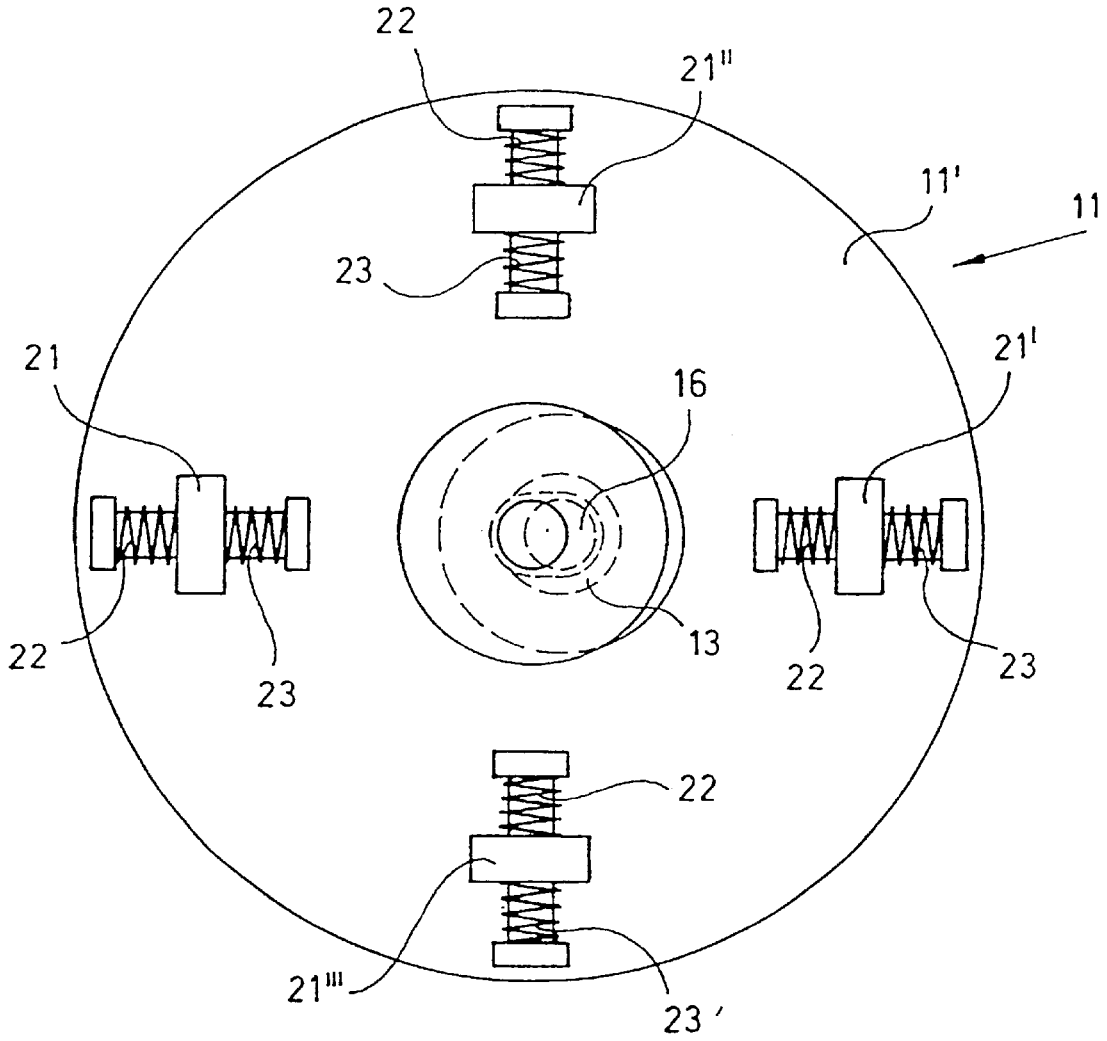
FIG. 3 shows a spherically formed supporting face of the inventive grinding apparatus in a view from the back.

With spherically formed supporting face 11 shown in FIG. 3, rolling bearings 21, 21', 21" and 21'" are disposed adjacent lower side 11' thereof, rolling bearings 21, 21' and 21", 21'" being disposed axis-parallel in pairs. Like the rolling bearings shown in FIG. 2, rolling bearings 21, 21', 21" and 21'" shown in FIG. 3 are mounted reciprocatingly in springs 22, 23. This permits circular motion of spherical supporting face 11 during operation of the inventive grinding apparatus.

Figure 4:
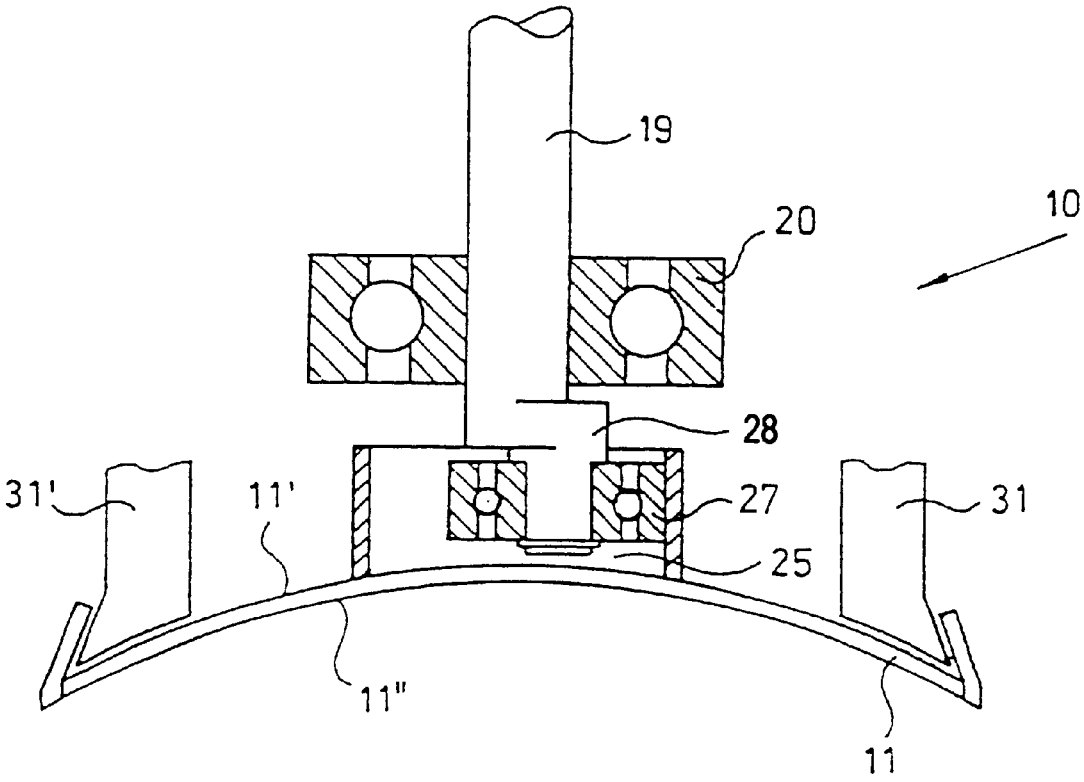
FIG. 4 shows a further preferred embodiment of the inventive grinding apparatus in a cross-sectional view.
Figure 5:
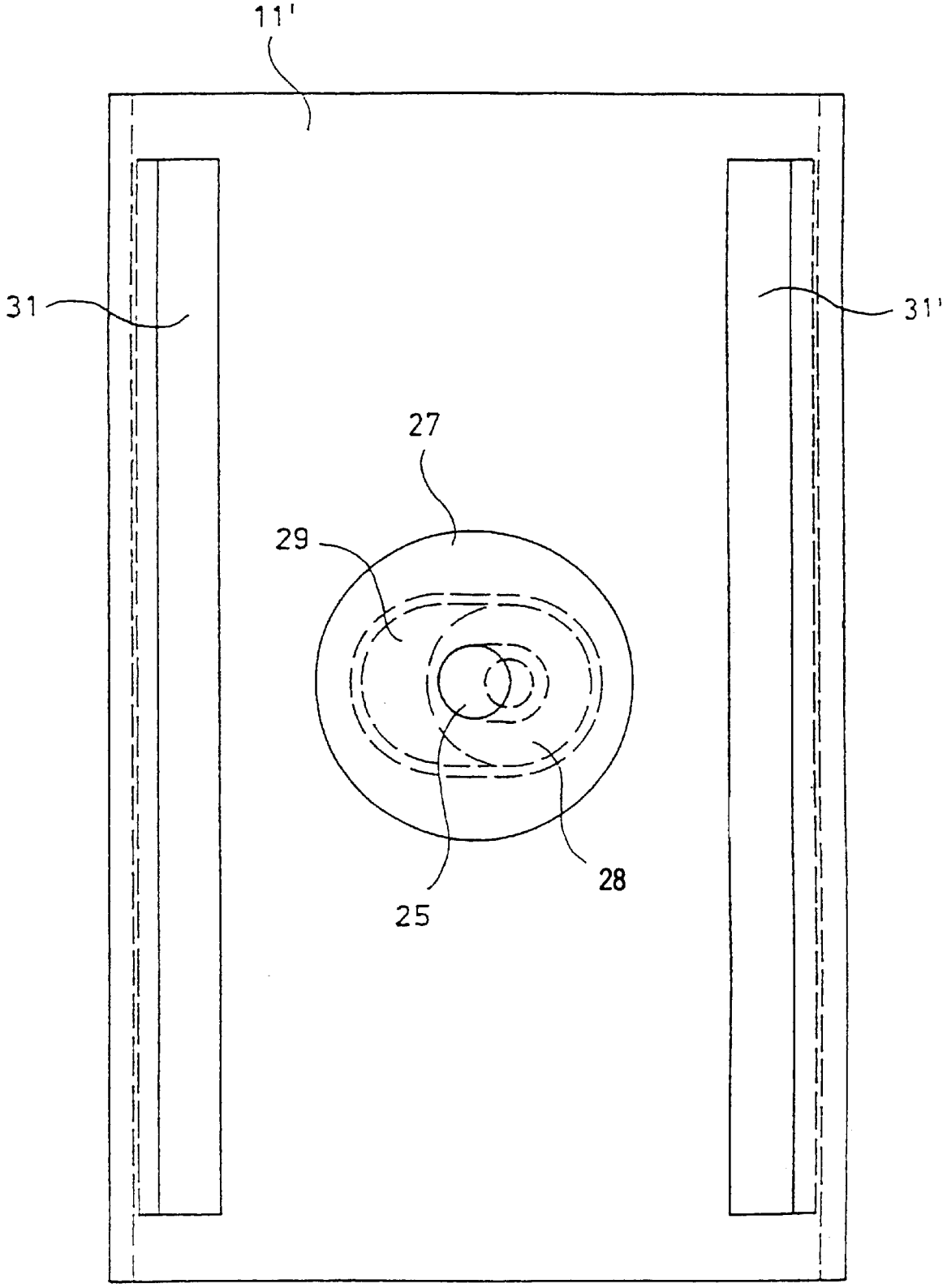
FIG. 5 shows the supporting face and head of the grinding apparatus shown in FIG. 4 in a view from the back.

In the embodiment of the inventive apparatus 10 shown in FIGS. 3 and 4, a cross-sectional view being shown in FIG. 4 and supporting face 11 and head 25 shown in a view from the back in FIG. 5, shaft 28 of head 25 is mounted in vertically extending long hole 29 formed in component 27 and turning rotating motion of the particular component into linear, horizontally extending oscillating motion of head 25. The guide devices are formed in this embodiment as guide faces 31, 31' made of hard plastic material with sliding ability and have a curvature adapted to lower side 11' of the supporting face. This embodiment of the inventive apparatus is suitable in particular for grinding applications in which the surface to be ground is limited by obstructing objects on one side.

The above-explained examples of the invention serve merely the purpose of illustrating the inventive teaching given by the patent claims, which as such is not restricted to the examples.

What is claimed is:

1. A grinding apparatus with a rotor device driving an eccentrically mounted carrier device in which a shaft is mounted provided at one end with a head to which a supporting face for abrasive paper is fastened, characterized in that the supporting face is of curved design and has curved upper and lower sides, the supporting face is fastened to the head via an elastic element, and at least two guide devices are provided which cause the supporting face to be guided by the head reciprocatingly along a curved surface with the same radius of curvature as the supporting face.

2. An apparatus according to claim 1, characterized in that the guide devices are provided on the lower side of the supporting face.

3. An apparatus according to claim 1, characterized in that the guide devices are formed as ball-bearings, rolling bearings or slide bearings.

4. An apparatus according to claim 1, characterized in that the guide devices are formed as curved guide faces made of hard material with sliding ability, and have a curvature adapted to the lower side of the supporting face.

5. An apparatus according to claim 1, characterized in that three guide devices are provided.

6. An apparatus according to claim 1, characterized in that the elastic element is formed as a spring.

7. An apparatus according to claim 1, characterized in that the elastic element is formed as a disk or ring of elastic material.

8. An apparatus according to claim 1, characterized in that the supporting face is formed cylindrically with a convex upper side.

9. An apparatus according to claim 8, characterized in that the guide devices are disposed axis-parallel to each other.

10. An apparatus according to claim 8, characterized in that the supporting face is formed so as to have at least two different curvatures in two or more planes.

11. An apparatus according to claim 1, characterized in that the supporting face is formed cylindrically with a concave upper side.

12. An apparatus according to claim 1, characterized in that the supporting face is formed spherically with a convex upper side.

13. An apparatus according to claim 12, characterized in that four guide devices are provided which are disposed in pairs at right angles to each other.

14. An apparatus according to claim 1, characterized in that the supporting face is formed spherically with a concave upper side.

15. An apparatus according to claim 1, characterized in that the supporting face is made of hard material.

16. An apparatus according to claim 1, characterized in that the curved upper and lower sides of the supporting face have a radius of curvature dimensioned such that the upper and lower sides have a common summit.

17. An apparatus according to claim 1, characterized in that an additional eccentric device is provided for controlling the motion of the supporting face further in presettable fashion.

18. An apparatus according to claim 17, characterized in that the additional eccentric device is controllable via centrifugal forces and/or frictional forces.

19. An apparatus according to claim 1, characterized in that the eccentrically mounted carrier device, the shaft mounted therein or the head provided at one end thereof is mounted in a long hole which turns rotating motion of said eccentrically mounted carrier device, shaft mounted therein or head into one-dimensional linear oscillating motion.

20. An apparatus according to claim 19, characterized in that the long hole is disposed vertically and produces horizontally extending oscillating motion.

21. An apparatus according to claim 19, characterized in that the long hole is disposed horizontally and produces vertically extending oscillating motion.

* * * * *